United States Patent [19]

Johnson

[11] 4,245,772

[45] Jan. 20, 1981

[54] CARTON HAVING RECLOSABLE OR REMOVABLE TOP AND BLANK FOR FORMING SAME

[75] Inventor: Ronald V. Johnson, Port Washington, Wis.

[73] Assignee: Champion International Corporation, Stamford, Conn.

[21] Appl. No.: 57,165

[22] Filed: Jul. 13, 1979

[51] Int. Cl.[3] ..... B65D 5/22; B65D 5/54

[52] U.S. Cl. ..... 229/33; 206/633

[58] Field of Search ..... 206/633, 626; 229/33

[56] References Cited

U.S. PATENT DOCUMENTS

| | | | |
|---|---|---|---|
| 493,921 | 3/1893 | Gair | 229/33 |
| 1,509,383 | 9/1924 | Walter | 229/33 |
| 2,114,134 | 4/1938 | Weiss | 206/626 X |
| 2,557,914 | 6/1951 | Miller | 206/626 |
| 2,774,529 | 12/1956 | Abrams et al. | 229/33 |
| 3,195,800 | 7/1965 | Cote | 229/33 X |
| 3,529,764 | 9/1970 | Reeves et al. | 206/633 |
| 4,003,516 | 1/1977 | Commerford et al. | 206/633 |

FOREIGN PATENT DOCUMENTS

| | | | |
|---|---|---|---|
| 1484146 | 6/1967 | France | 229/33 |

*Primary Examiner*—Stephen P. Garbe

*Attorney, Agent, or Firm*—Evelyn M. Sommer

[57] ABSTRACT

A carton formed from a planar, unitary blank of paperboard which has bottom, front, back and side panels. A top panel with laps on its sides is hinged to the back panel. A glue lap or adhesive tape seals the top panel closed, while permitting it to be easily opened. This carton securely and safely stores its contents and is capable of being easily opened, reclosed and formed into a dispensing tray by removal of the top panel.

1 Claim, 7 Drawing Figures

CARTON HAVING RECLOSABLE OR REMOVABLE TOP AND BLANK FOR FORMING SAME

BACKGROUND OF THE INVENTION

The present invention relates to a carton and a blank for forming a carton. More particularly, the present invention relates to a carton and a blank for forming a carton in which the carton has a top panel which may be easily sealed closed, opened for permitting access to the contents of the carton, reclosed for further shipping and storing of the carton and its contents, and removed for forming a dispensing tray for the contents thereof.

Typically, at a retail store, the goods are shipped in a paperboard carton. At the store, the carton must be opened in such a manner to expose the goods to facilitate the marking of the appropriate price thereon. Thereafter, the carton is usually reclosed and stored in a condition in which the contents are fully protected until needed. When needed, the carton must be opened in such a manner so that the contents may be easily dispensed therefrom. Thus, it is advantageous for a single carton to be capable of being easily sealed closed, opened to permit access to the contents of the carton for marking, reclosed for further shipping and storing, and formed into a dispensing tray.

SUMMARY OF THE INVENTION

Accordingly, it is an object of the present invention to provide a carton and a blank for forming a carton which may be easily sealed about its contents and easily opened.

Another object of the present invention is to provide a carton and a blank for forming a carton which may be easily and securely reclosed to protect the contents of the carton after the carton had been initially opened.

A further object of the present invention is to provide a carton and a blank for forming a carton in which the carton may be easily formed into a tray for dispensing the contents of the carton.

An additional object of the present invention is to provide a carton and a blank for forming a carton which is strong, reusable, simple to assemble, simple and inexpensive to manufacture, and adaptable to a wide variety of contents.

The foregoing objects are obtained by providing a carton formed from a foldable, paperboard blank comprising a bottom panel, first and second side panels attached to opposite side edges of the bottom panel, front and back panels attached to the bottom panel at opposite front and back edges thereof, respectively, and attached to the side panels, a top panel hingedly attached to the back panel at an edge thereof remote from the bottom panel and having first and second top flaps attached to opposite side edges thereof, and a glue lap hingedly attached to one of the top and front panels at an edge thereof adjacent the other of the top and front panels to overlap at least a portion of the other of the top and front panels, whereby the top panel is movable between a sealed closed position in which the top and front panels are fixedly attached by the glue lap, an open position in which the top and front panels are spaced apart, and a reclosed position in which the glue lap is overlapped by the other of the top and front panels.

The foregoing objects are also obtained by providing a planar, unitary blank formed of paperboard and adapted to be folded into a carton comprising a bottom panel having first and second side panels hingedly attached at opposite side edges of the bottom panel along fold lines, front and back panels attached to the bottom panel at opposite front and back edges thereof, respectively, along fold lines, flap means for securing the side panels to the front and back panels, a top panel hingedly attached to said back panel at an edge thereof remote from the bottom panel along a fold line and having first and second top flaps hingedly attached to opposite side edges thereof along fold lines, and a glued lap hingedly attached to one of the top and front panels along a fold line.

The foregoing objects are additionally obtained by providing a carton formed from a foldable, paperboard blank comprising a bottom panel, first and second side panels attached at opposite side edges of the bottom panel, front and back panels attached to the bottom panel at opposite front and back edges thereof, respectively, and attached to the side panels, a top panel hingedly attached to the back panel at an edge thereof remote from the bottom panel and having first and second top flaps attached to opposite sides thereof, and adhesive tape means attached to adjacent edge portions of the top and front panels for releasably sealing the carton.

By forming the carton and blank therefor in this manner, the top panel may be easily closed and sealed, the top panel may be reopened easily, the top panel may be reclosed to securely close the carton and protect the contents thereof, and the top panel may be removed to form a tray which will facilitate dispensing of the contents of the carton. Thus, the operations necessary for cartons for retail store products are provided by a single carton.

Other objects, advantages and salient features of the present invention will become apparent from the following detailed description, which taken in conjunction with the annexed drawings, discloses preferred embodiments of the present invention.

As used in this application, the terms "bottom", "side", "top", "front" and "back", are intended to facilitate the description of the carton and the blank for forming the carton. Thus, such terms are merely illustrative of the carton and are not intended to limit the carton or blank to any specific orientation.

BRIEF DESCRIPTION OF THE DRAWINGS

Referring to the drawings which form a part of this original disclosure.

DETAILED DESCRIPTION OF THE PREFERRED EMBODIMENTS OF THE INVENTION

Figure 1:
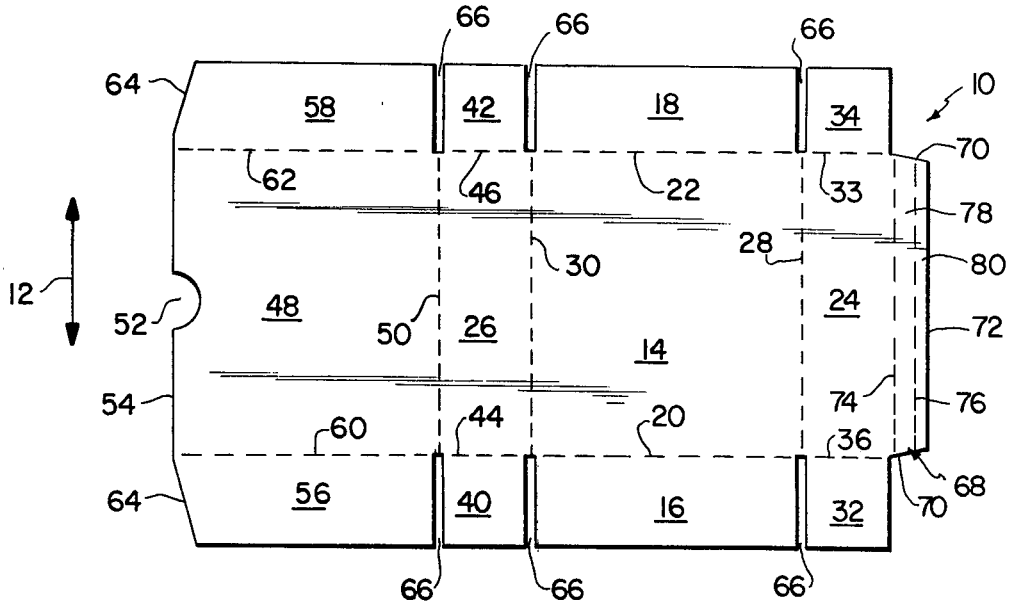
FIG. 1 is a plan view illustrating a blank for forming a carton in accordance with the present invention.

Referring to FIG. 1, a blank comprises a planar, unitary member formed of paperboard, usually corrugated cardboard. Preferably, the corrugations are oriented in directions parallel to the line 12.

The blank 10 comprises a rectangular bottom panel 14. First and second rectangular side panels 16, 18 are attached to and extend from opposite side edges of the bottom panel 14. A first fold line 20 extends along the entire length of the juncture between the bottom panel 14 and the first side panel 16. A second fold line 22 extends along the entire length of the juncture between the second side panel 18 and the bottom panel 14. The fold lines 20, 22 hingedly couple each of the side panels 16, 18 to the bottom panel 14.

Front and back rectangular panels 24, 26 are attached to and extend from opposite front and back edges, respectively, of the bottom panel 14. A third fold line 28 extends along the entire length of the juncture between the front panel 24 and the bottom panel 14. A fourth fold line 30 extends along the entire length of the juncture between the back panel 26 and the bottom panel 14. The fold lines 28, 30 hingedly couple each of the front and back panels 24, 26 to the bottom panel 14.

The front panel 24 has first and second rectangular front flaps 32, 34 which are attached to and extend from opposite side edges of the front panel 24. A fifth fold line 36 extends along the entire length of the juncture of the front panel 24 and the first front flap 32. A sixth fold line 33 extends along the entire length of the juncture of the front panel 24 and the second front flap 34.

The back panel 26 has first and second rectangular back flaps 40, 42 which are attached to and extend from opposite side edges of the back panel 26. A seventh fold line 44 extends along the entire length of the juncture between the back panel 26 and the first back flap 40. An eighth fold line 46 extends along the entire length of the juncture between the back panel 26 and the second back flap 42.

The fold lines 36, 33, 44, 46 hingedly couple the front flaps 32, 34 and the back flaps 40, 42 to the front panel 24 and the back panel 26, respectively. As will be explained in detail hereinafter, the flaps 32, 34, 40, 42 provide means for securing the side panels 16, 18 to the front and back panels 24, 26.

A top panel 48 is attached to and extends from an edge of the back panel 26 remote from the bottom panel 14. The top panel 48 is generally rectangular. A ninth fold line 50 extends along the entire length of the juncture of the back panel 26 and the top panel 48 to hingedly couple the top panel 48 to the back panel 26. The fold line 50 may be scored to facilitate removal of the top panel 48 from the back panel 26 as will be described hereinafter. A notch 52 is formed in the edge 54 remote from the back panel 26 to facilitate manipulation of the top panel 48.

First and second generally rectangular top flaps 56, 58 are attached to and extend from opposite side edges of the top panel 48. A tenth fold line 60 extends along the entire length of the jucture between the first top flap 56 and the top panel 48. An eleventh fold line 62 extends along the entire length of the juncture between the top panel 48 and the second top flap 58. The fold lines 60, 62 hingedly couple each of the top flaps 56, 58 to the top panel 48. The front edges 64, i.e., those adjacent the edge 54, are chamfered.

Slots 66 are formed in the periphery of the blank 10 to separate the front flaps 32, 34 from the side panels 16, 18, to separate the side panels 16, 18 from the back flaps 40, 42, and to separate the back flaps 40, 42 from the top flaps 56, 58, respectively.

A generally rectangular glue lap 68 is attached to and extends from an edge of the front panel 24 remote from the bottom panel 14. The side edges 70 of the glue lap 68 are slightly tapered from the attachment of the glue lap 68 and the front panel 24 to the free edge 72 of the glue lap 68. A twelfth fold line 74 extends along the entire length of the juncture of the glue lap 68 and the front panel 24 to provide a hinged coupling therebetween. A reverse fold line 76 extends approximately halfway between and parallel to the fold line 74 and the free edge 72. The reverse fold line 76 permits bending of the blank 10 in a direction opposite to all other fold lines and divides the glue lap 68 into inner and outer portions 78, 80.

The positioning of the notch 52 and of the glue lap 68 may be reversed in that the glue lap may be attached to the top panel 48 and the notch formed in the front panel 24, in lieu of the arrangement illustrated.

Figure 2:
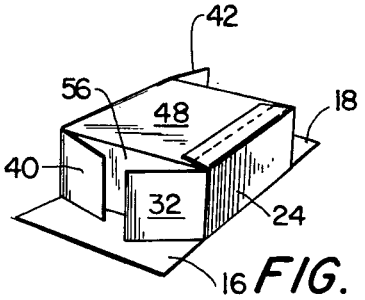
FIG. 2 is a perspective view illustrating the blank of FIG. 1 in a partially folded position.
Figure 3:
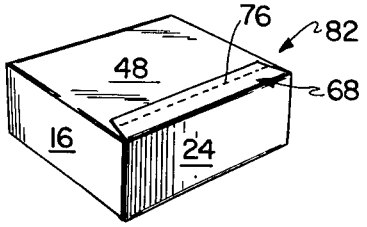
FIG. 3 is a perspective view illustrating the blank of FIG. 1 in a fully folded position.

To form the carton 82 illustrated in FIG. 3, the blank 10 must be folded and glued. As a first step, the blank 10 is formed into a tube by adhering the glue lap 68 to the outside surface of the top panel 48 adjacent the edge 54. Then the top flaps 56, 58 are rotated approximately 90° until the inside surfaces thereof bear against the contents of the carton. Once the top flaps 56, 58 are in position, the front flaps 32, 34 and the back flaps 40, 42 are pivoted 90° until they come into contact with the top flaps 56, 58 (see FIG. 2). Thereafter, adhesive is applied to the inside surface of the side panels 16, 18, and the side panels 16, 18 are pivoted 90° until they are in contact with the flaps 32, 34, 40, 42 to finally close and seal the carton 82.

When the glue is applied to the glue lap 68, the adhesive is only applied on the inner portion 78. The outer portion 80 is free of any adhesive. In this manner, the detachment of the glue lap 68 from the top panel 48 is facilitated. Likewise, the provision of the reverse fold 76 between the inner and outer portions 78, 80 facilitates moving of the outer portion 80 to a position at an angle relative to the top panel 48 to enable a person to securely grip the glue lap 68 to detach it from the top panel 48.

Figure 4:
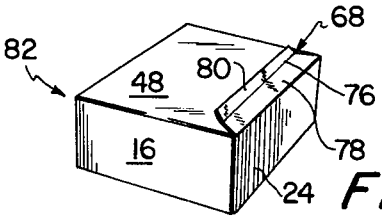
FIG. 4 is a perspective view illustrating the carton of FIG. 3 as it is about to be opened.

The opening of the carton is illustrated in FIG. 4. To accomplish opening of the carton 82, the outer portion 80 of the glue lap 68 is pivoted to a position at which it is oriented at an angle relative to the top panel 48. The outer portion 80 is gripped tightly in order to pull the glue lap 68 upwardly and forwardly to break the adhesion between the glue lap 68 and a top panel 48. Once the glue lap 68 is removed from the top panel 48, a finger may be inserted within the notch 52 and the top panel 48 pivoted upwardly to the position illustrated in FIG. 6 to expose the contents of the carton 82.

Figure 5:
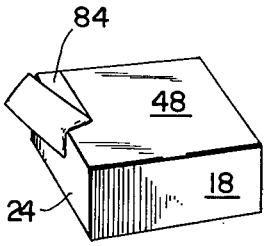
FIG. 5 is a perspective view illustrating the opening of a carton according to a second embodiment of the present invention.

In FIG. 5, an alternative embodiment of the invention is illustrated. In this embodiment, the glue lap 68 is omitted. In lieu of the glue lap, adhesive tape 82 is attached to adjacent edge portions of the front panel 24 and the top panel 48 for releasably sealing the carton. This carton may be opened by peeling the tape 82 off, as illustrated, or by cutting the tape 82. Otherwise, the embodiment illustrated in FIG. 5 is identical to that described hereinabove.

Figure 6:
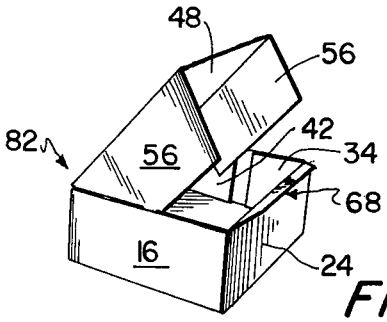
FIG. 6 is a perspective view illustrating the carton of FIG. 3 in its open position.
Figure 7:
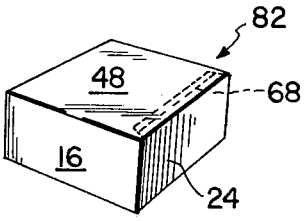
FIG. 7 is a perspective view of the carton of FIG. 3 in its reclosed position.

The reclosed position of the carton 82 is illustrated in FIG. 7. Starting from the position illustrated in FIG. 6, the glue lap 68 is pivoted to the interior of the carton 82 and then the top panel 48 is pivoted downwardly into a closed position to reclose the carton. In this position, the top flaps 56, 58 overlap the side panels 16, 18 and the flaps 32, 34, 40, 42 and are in sliding engagement with the flaps 32, 34, 40, 42. The chamfered edges 64 of the top flaps and the tapered edges 70 of the glue lap 68 facilitate movement thereof by avoiding contact with the remainder of the carton structure.

To use the carton 82 as a display or dispensing tray, the top panel 48 is pivoted upwardly to the position generally illustrated in FIG. 6. Thereafter, the top panel 48 is separated from the back panel by severing the carton along the score or fold line 50. In this manner, the contents of the carton will be securely retained therein while access is permitted to the contents from the top While particular embodiments have been chosen to illustrate the invention, it will be understood by those skilled in this art that various changes and modifications can be made therein without departing from the scope of the invention as defined in the appended claims.

What is claimed is:

1. A planar, unitary blank formed of paperboard and adapted to be folded into a carton comprising:

a bottom panel having first and second side panels hingedly attached at opposite side edges of said bottom panel along fold lines;

front and back panels attached to said bottom panel on opposite front and back edges thereof, respectively, along fold lines;

flap means for securing said side panels to said front and back panels;

a top panel hingedly attached to said back panel at an edge thereof remote from said bottom panel along a scored fold line to facilitate separation thereof, said top panel having first and second top flaps hingedly attached to opposite side edges thereof along fold lines, with the edges of said top flaps remote from said back panel being chamfered, and said top panel having a notch formed in an edge thereof remote from said back panel; and a glue lap hingedly attached to said front panel along a fold line, the side edges of said glue lap being tapered from the attachment of said glue lap to said front panel to the free edge of said glue lap, said glue lap having a reverse fold line therein extending parallel to the fold line between said glue lap and said front panel.

* * * * *